US005212914A

United States Patent [19]

Martin et al.

[11] Patent Number: 5,212,914

[45] Date of Patent: May 25, 1993

[54] WALL PANELING SYSTEM WITH WATER GUTTERING DEVICE

[75] Inventors: Manuel F. Martin, Greenlawn; Thomas K. Rowden, Port Washington, both of N.Y.

[73] Assignee: Alu Tech Systems, Inc., Deer Park, N.Y.

[21] Appl. No.: 706,229

[22] Filed: May 28, 1991

[51] Int. Cl.[5] ..... E04H 1/00; E04F 13/08; E04D 1/00

[52] U.S. Cl. ..... 52/235; 52/386; 52/392; 52/533; 52/512

[58] Field of Search ..... 52/235, 533, 506, 262, 52/480, 580, 489, 588, 589, 591, 594, 386, 387, 392, 508-513, 488

[56] References Cited

U.S. PATENT DOCUMENTS

| | | | |
|---|---|---|---|
| 490,186 | 1/1893 | Cherest | 52/509 |
| 1,933,221 | 10/1933 | Rockhoff | 52/508 |
| 2,116,530 | 5/1938 | McCabe | 52/489 |
| 2,139,322 | 12/1938 | Miner | 52/474 |
| 2,251,991 | 8/1941 | Fellner | 52/489 |
| 2,862,585 | 12/1958 | McChesney | 52/508 |
| 2,877,877 | 3/1959 | Davis | 52/509 |

*Primary Examiner*—James L. Ridgill, Jr.
*Attorney, Agent, or Firm*—Levisohn, Lerner & Berger

[57] ABSTRACT

Pan-like aluminum panels are formed for finishing the exterior of a building. Secured to the flanges or outside edges of the panels are extruded male and female channel members; the male members secured at a pair of adjacent flanges and the female members secured at the other pair of adjacent flanges. To install the panels, the female edges are first screwed to the wall of the building. Then the male members of panels are slidably received and interlocked within the female members of adjacent panels. Female members of the adjacent panels are then screwed to the wall of the building, thereby exposing them for male members of yet another panel; and so on. Rows and columns of panels are thus secured to the building. An X-shaped gutter member provides mechanical and fluid continuity for the channels formed between the male and female members of adjacent panels, to eliminate moisture from becoming trapped inside.

22 Claims, 3 Drawing Sheets

WALL PANELING SYSTEM WITH WATER GUTTERING DEVICE

BACKGROUND OF THE INVENTION

This invention relates to a system for installing aluminum panels to exterior walls of a building, and in particular, provides an efficient mechanism for attaching such panels effectively, at minimum labor and material cost, and with minimum moisture problems.

Exterior wall panel systems for finishing or refinishing the exteriors of commercial and/or industrial buildings are well known. One commonly-used panel system is based on aluminum/plastic/aluminum composite pan-like panels in which each panel has a skin of aluminum as the exterior of the panel system.

For example, U.S. Pat. No. 4,607,471 relates to a panel wall system employing a multiplicity of pan-like rectangular panels arranged side by side and end to end in closely spaced relation. That system, like the present invention, can be secured to an existing exterior wall of a building or alternatively to a metallic structure, metal studs, screwed to the outside wall. The system disclosed in the '471 patent requires at least three individual parts for field installation, and that system, when assembled to a building, fails to adequately prevent water from seeping behind the wall panels and becoming lodged and trapped between the panels and the exterior surface of the building to which the panels are attached. Ineffective drainage of such water ultimately presents serious decay/rust problems and can, over time, degrade panel wall installations.

An object of the present invention is to provide a panel system attachable to the exterior of a building, whether attached directly to the outside wall or to the system of metal stud work, which is easy and inexpensive to install, comprises relatively few field parts and which prevents water and/or moisture from collecting behind and between the panels and the exterior of the building to which the panels are attached.

An object of the present invention is to provide a paneling system for a building in which the assembly of individual panel assemblies to an exterior wall or a metallic stud structure can be accomplished quickly, with minimum labor and yet provide sufficient structural strength and rigidity to be durable and long lasting. In addition, it is an object of the present invention to provide a panel-like system wherein the water or moisture which may become accidently trapped behind the sealant located between adjacent panels will, nevertheless, be redirected out to the outside by guttering splices which serve to connect channelways or passageways of adjacent pairs of panels. In this way the removal of any such water or moisture is facilitated. The male and female channel members, when attached to the flanges of the pan-like panels, provide additional structural strength and rigidity to the panels and enhance durability during installation and, in addition, provide for long lasting structural integrity over various weather conditions.

DESCRIPTION OF THE PRIOR ART

U.S. Pat. No. 4,607,471 to Olsen is one of many patents issued to Construction Specialties Incorporated which generally relates to this field. Many of the prior patents relate to Construction Specialties' Tech Wall System. The '471 patent shows the construction of a two dimensional wall from a plurality of panlike panels which are secured to the wall by utilization of channel members which are welded or otherwise secured to the flanges of the pans and to the walls. FIG. 3 of the '471 patent shows how a channel member is secured to the flange edge of the panel and the channel member secured to a retainer 22 or, alternatively, it can be secured directly to the wall, itself. The above located panel, however, in contrast to the present invention, is not receptively received by the first channel member but, rather, the pan-like panel itself overlays the channel member. FIG. 5 of the '471 patent shows a channel member 44, again, secured to the flange of a pan-like panel. This channel member is secured to the building structure. The other end of that panel member thus provides a female portion into which yet another male portion of an adjacent panel is receptively received. The '471 patent discloses vertical passageways (See FIG. 4 and the related description of the patent) for guttering of water. Column 5, lines 15 through 30 of the patent relate to the guttering of water. However, there is no separate mechanism or device for insuring continuity of the vertical guttering channels of adjacent pairs of panels nor is there any express nor implied suggestion of a guttering splice device to connect adjacent channels, to splice provided between the male and female members, themselves attached to the flanges of the pan-like panels, as is taught by the present invention. The splice device of the present invention, in contrast to the prior Construction Specialties' patents provides continuity of water flow and, in this manner, insures that no water will become trapped between the channel members or the pan-like panels.

U.S. Pat. No. 4,597,235 teaches an exterior panel wall assembly comprising a multiplicity of pan-like panel members arranged in rows and columns. This patent, too, is assigned to Construction Specialties, Incorporated of Cranford, New Jersey. The '235 patent contemplates vertical and horizontal channel members being secured directly to the wall structure with the pan-like panels being secured to the channel members by utilization of T-shaped mounting clips, secured to the channel members, which have ears, which, when turned, extend through corresponding oval slots in the side flanges of the panels (See FIG. 2). FIGS. 3 and 4 of the '235 patent and the related detailed description of those figures (See columns 3 through 6 of the '235 patent) relate to providing vertical and horizontal drainage channeling between adjacent pairs panels. However, again, there is no mechanism for insuring mechanical and fluid continuity between adjacent channel members to truly provide a water guttering system which insures that no water becomes trapped between adjacent pairs of panels or within the channel members. The drainage channels of the '235 patent, in both the horizontal and vertical direction are notched in order to try to facilitate the removal of water and moisture from the interior of the panel members. However, again, there is neither a teaching nor a suggestion of a gutter splice-like device which serves to mechanically connect and provide fluid continuity in both the horizontal and the vertical direction, as provided by the present invention.

U.S. Pat. No. 4,506,484 shows the Tech Wall System and the manner of securing panels by use of the "T" clip. This patent also describes water drainage troughs (See columns 5 though 8).

U.S. Pat. No. 4,622,794 also relates to a panel wall system comprised of a plurality of rectangular pan-like panels. This patent is directed to the combination of slots in the flanges of the panels and the T-clips (See FIGS. 2 and 3) which serves to secure the panels to the horizontal and vertical support members which are first directly secured to the wall structure. In contrast, the present invention contemplates that the channel members are secured to the pan-like panels at the factory and not at the site and, in this manner, the present invention is far easier and less expensive to install on site.

U.S. Pat. No. 4,924,647 relates to a drainage system for removing rainwater and internal moisture from the rear of exterior wall panels. According to the '647 patent, drain tubes 6 (See FIG. 1) and horizontal gutters 14 try to provide for the proper drainage of water from behind panel structures. Here, again, however, there is no teaching of a gutter splice member which insures fluid continuity between adjacent pairs of panels or adjacent channels in both the horizontal and the vertical directions.

U.S. Pat. No. 4,685,263 shows an internal gutter 37 (See FIG. 3) and a weep hole 42 which together seek to insure proper drainage between adjacent panel members. There is, however, no provision made for ensuring fluid continuity between adjacent pairs of panel assemblies. In addition, a review of the specification and drawings of the '263 patent reveals that fabrication and installation is more complicated, involves more parts and is, therefore, more time consuming and expensive in comparison to the simplicity and fewer parts of the present invention. There is no suggestion in the '263 patent of a gutter splice for fluid (water and moisture) continuity between adjacent pairs of panels.

U.S. Pat. No. 4,936,078 also relates to providing an internal channel which serves as a rain gutter for interlocking panels. A channel 68 allows water to flow within the panels, without exerting pressure on the seal. Here, again, there is no suggestion of providing a gutter splice device which insures fluid continuity between adjacent panels in both the vertical and the horizontal directions.

U.S. Pat. No. 4,866,896 is another patent to Construction Specialties Incorporated for its panel system. Here, again, horizontal and vertical retaining members are first secured to the wall of the building and the panels then hung onto the horizontal and vertical members. Again, this is in contrast to the present invention which contemplates that the male and female channel members be secured to the pan-like panel prior to delivery to the site for ultimate installation on a building structure. Drainage of water is provided in the '896 patent through recesses 22*a*, 24*e*, and 26*e* which open outwardly toward the panel's perimeter, in the horizontal direction, while vertical wall drains are provided through vertical tracks 56.

U.S. Pat. No. 4,184,301 also relates to a wall paneling system wherein a core material is secured between metallic-like skins. Securement to the wall of a female channel-like member of a panel with an male end of an adjacent panel slidably received within the female cavity is generally disclosed. The male members then cover the screw fasteners 42. The '301 patent does not teach a gutter splice for ensuring fluid continuity between adjacent pairs of panels. Also, the '301 patent does not provide a flat facade to the building but, rather, it appears with ridges. See, also, U.S. Pat. No. 3,303,620 for additional background.

Additional patents which generally relate to the field of building and constructing two-dimensional panel-like walls for a building structure are as follows: U.S. Pat. No. 4,680,911 to Davis, et al. entitled Decorative Wall Covering; U.S. Pat. No. 4,316,351 to Ting entitled Thermally Insulated Building Construction Panel and a Wall Formed From Such Panels; U.S. Pat. No. 4,803,818 to Funaki entitled Roof Structure And Fixture Therefor; U.S. Pat. No. 4,700,520 also to Ting entitled Side Joint of Composite Metal Panel; U.S. Pat. No. 4,463,433 to Mullet entitled Sheet Material Roofing Panel; U.S. Pat. No. 4,341,917 to Martin entitled Building Structural Element; U.S. Pat. No. 4,283,897 to Thompson entitled Snap Action Panel Wall Construction; U.S. Pat. No. 3,514,915 to Johnson entitled Sheet Metal Wall Panel With Compressible Edge Seal; U.S. Pat. No. 3,101,820 to Snyder entitled Window Structure For Panel Type Buildings; U.S. Pat. No. 2,780,850 to Lieff entitled Construction Clip; U.S. Pat. No. 2,558,504 to Chocroun entitled System of Covering Walls with Metal Panels; U.S. Pat. No. 3,394,639 to Viehmann entitled Expansion Joint; U.S. Pat. No. 3,570,200 to Ritner & Baer entitled Partition Panel Structures; U.S. Pat. No. 3,608,266 to Satkin, et al. entitled Method And Apparatus For Constructing Removable Partition Walls; U.S. Pat. No. 3,722,163 to Satkin, et al. entitled Apparatus For Constructing Removable Partition Walls; U.S. Pat. No. 3,729,891 to Olsen entitled Decorative Openwork Panel; U.S. Pat. No. 3,779,660 to McGeary, et al. entitled Expansion Joint Seal; U.S. Pat. No. 3,888,599 to Reifsnyder entitled Expansion Joint Seal; U.S. Pat. No. 4,271,650 to Lynn-Jones entitled Expansion Joint Seal; U.S. Pat. No. 4,295,315 to Lynn-Jones entitled Expansion Joint Cover; and U.S. Pat. No. 3,815,309 to Olsen entitled Fastening System.

In addition to the above identified patents, the following brochures and promotional materials were also reviewed prior to preparation of this patent application: TECH WALL, Construction Specialties Inc., a member of the C/S Group of Companies, Copyright 1982 Conspec Systems, Inc.; INSULATED METAL BUILDING PANELS, H. F. Industries of Lumberton, New Jersey; POHL EUROPANEL, A High Tech Curtain Wall System using sophisticated German Bending Technology, Christian Pohl Gmbh of West Germany, Copyright 1985; INDUSTRIAL BUILDING PANELS of Troy Michigan; TECPAN ARCHITECTURAL PANEL SYSTEMS, Columbia Architectural Products, Incorporated of Beltsville, Maryland, Copyright 1989; CORRUGATED METALS INCORPORATED, Industrial Commercial Metal Roofing and Siding of Jersey City, New Jersey; ENERGY EFFICIENT ARCHITECTURAL WALL AND ROOF PANELS, by Alumina Shield Industries, Incorporated of Daytona Beach, Florida printed in Sep., 1988; EXPRESSIONS IN ARCHITECTURAL METAL CURTAIN WALL, by Alply of Decalb, Minnesota; METAL WALLS, ROOFING AND FASCIA, by Architectural Panels Incorporated of Pontiac Michigan; GRANCO FACTORY INSULATED ROOF AND WALL PANEL SYSTEMS, by Alumax Building Specialties Division of Mesquite, Texas; ARCHITECTURAL PREFORMED METAL ROOF AND WALL SYSTEMS, of ASC Pacific, Incorporated of West Sacramento, California printed in Aug. 1988; CURVED PROFILED PANELS FOR TODAY'S CREATIVE DESIGNER, by Curveline Incorporated of Ontario, California; QUALITY METAL ROOFING AND SIDING PANELS, by Flexospan of Sandy Lake Pennsylvania; WALL PANELS AND COLUMN COVERS, by Speck-Shulte Systems of Burnsville, Minnesota; INRYCO WALL SYSTEMS by Inryco Architectural Products of Pittsburgh, Pennsylvania, copyright 1988; INSULATED METAL WALL AND ROOF PANELS by Insulated Panel Systems of Stafford (Houston) Texas; HONEYCOMB METAL PANELS, by Procom Manufacturing of Henderson, Nevada; PROTECTED METAL WALL/ROOF PANELS, by H. H. Robertson Company of Pittsburgh, Pennsylvania, copyright 1988; METAL WALL AND ROOF SYSTEMS, by E. G. Smith Construction Products of Pittsburgh, Pennsylvania; EXTERIOR SURFACE CLADDING, from Alliance Wall, by Alliance Wall of Norcross, Georgia, copyright 1988; ALUCOBOND MATERIAL by Alucobond Technologies, Incorporated of Benton, Kentucky; UNA-FAB PANEL LINE, Copper Sales Incorporated of Minneapolis, Minnesota; LURIE PANELS by Lurie Panels, Incorporated of Milwaukee, Wisconsin; MAPES PORCELAIN ON ALUMINUM ARCHITECTURAL BUILDING PANELS by Mapes Industries Incorporated of Lincoln, Nebraska; POSIT BUILDING PANELS by Novaspan Panels Systems, Incorporated of Concord Ontario, Canada; WEYERHAEUSER ARCHITECTURAL PANELS by Weyerhaeuser of Tacoma Washington.

While many of the systems described in the brochures and promotional materials provide for exterior wall panels and many use gaskets to prevent or seek to prevent water from seeping in between the panels, there is no positive guttering system, no guttering splice mechanism, which provides fluid continuity from a channel between a pair of panels to a channel between a pair of adjacent panels.

In simplistic terms, the present invention uses only three component parts which are factory connected and, at the installation site, only two components. The panel assembly is delivered, pre-assembled, ready for rapid and cost effective installation. Only the guttering splice and screws are added. The extruded channel members are secured to the pan-like panel as one unit to be delivered to the installation site. The only other required component (other than screws for attaching the panel members to the wall) is the gutter splice and follow-up caulking and sealant. Therefore, the present invention basically contemplates two items for physical handling, namely, the panel with the pre-assembled channels members attached thereto and the gutter splice. In this manner, labor, time and training is minimized and the installation of the present invention is extremely cost effective. In addition, as will be more fully explained, the utilization of the gutter splice mechanism serves to positively insure that the channels formed between the male and female extruded channel members of adjacent pan-like panels are connected together so that no water or moisture is trapped between the channels and the pan-like panels.

In comparison, however, the prior art basically shows a plurality of components for handling by the installation team, which, necessarily, requires more time and better trained installers. Obviously, where labor cost is a principal component of building construction, it is a desirable object to minimize installation costs.

The present invention provides for male and female extrusions which are directly attached to the side flanges of the pan-like panel, at the factory. The channel members extend for substantially the entire length of the sides of the panel. The male and female extrusions facilitate rapid installation, and, in addition, provide structural rigidity to the pan-like panel. The present invention also provides substantially continuous guttering for water and moisture. This is insured by utilization of a gutter splice mechanism which insures continuity between channels formed between pairs of adjacent panels.

SUMMARY OF THE INVENTION

In accordance with the principals of this invention, the above objects are accomplished by providing tongue and groove aluminum extrusion members which are pre-assembled and attached to the individual aluminum panels off site. In particular, each aluminum panel has the basic structure of a aluminum pan with four flanges defining the edges of the panels. A pair of extruded metal male channel members are welded or attached to a pair of adjacent edges of the aluminum panel, and an extruded metal female channel member is attached to the other pair of adjacent edges or flanges of the aluminum panel. With multiple panels assembled as such adjacent panels interlock one with the other, male into adjacent female. When at the building site, individual aluminum panels are readily joined together by utilizing the tongue and grooves, male into female, to form a structurally strong, easy assembly of a wall panel system.

As another aspect of this invention, a guttering or water drainage system is formed between the passageways formed between mating channel members. A guttering splice is installed at the adjoining corners of the respective panels so as to form continuous vertical and horizontal water/moisture passageways or gutters throughout the panel system, thereby insuring that water which somehow finds it way into the panel interstices will be carried vertically and/or horizontally out of the wall panel structure assembly.

Another object of the present invention is to provide such an exterior panel system having enhanced structural rigidity and strength of the aluminum panels attached to the building.

Other objects, advantages and features of this invention will become more apparent from the detailed description. The specifics of the wall panel assembly of the present invention will be seen in the following drawings.

DETAILED DESCRIPTION OF THE DRAWINGS AND THE PREFERRED EMBODIMENT

Figure 1:
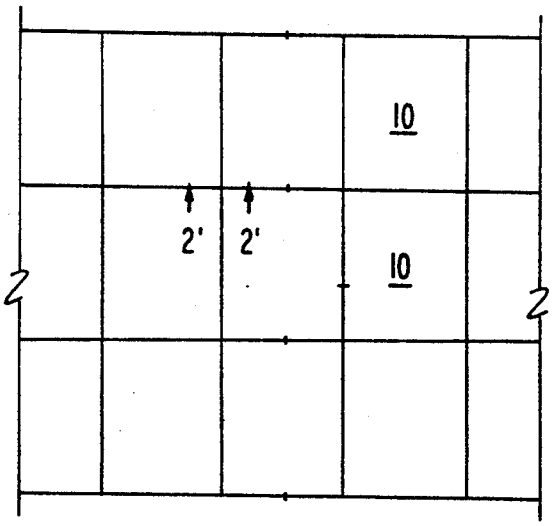
FIG. 1 is a front elevational view showing the finished assembly of a plurality of aluminum panels in both a horizontal and vertical matrix with the panels abutting edge to edge and secured to the exterior of a building.

FIG. 1 of the drawings schematically shows a typical cluster of panels 10 making up a vertical plane section of an exterior building wall. The panels 10, shown in the drawings, are representative of the design concept of the present invention, but it will be understood by those skilled in the art that a complete building facing system will usually include special details at various locations of the building facade such as window sill treatments, wall edges, window heads and alike. These special treatments are not part of the invention disclosed and claimed in this application, and it is the intent of the present application to cover merely a typical assembly of panels that make up part of a panel wall assembly used in conjunction with special details of the type referred to.

FIG. 1 of the drawings is intended primarily for orientation and to illustrate that the invention comprises a plurality of basically rectangular pan-like panels 10 arranged side by side in rows and end to end in columns in closely spaced relation. A typical panel 10, as shown in FIGS. 3 and 4, comprises a rectangular principal wall 12, and side flanges 14 and 16 (See FIG. 2) along each side edge of the principal wall, said flanges extending toward the building structure, a top flange 18 along the top edge of the principal wall 12 also extending toward the building structure and a bottom flange 20 extending along the bottom edge of the principal wall and also extending toward the building structure. The flanges preferably extend about 1⅜" deep from the principal wall.

The pan-like panels 10 are preferably custom fabricated from 0.125" thick aluminum sheet 5052H-32 alloy. According to the preferred embodiment of the present invention, the panels shall be painted with a high performance powder coating for commercial architectural metal. The panel tolerances, preferably, are such that the panel bow will be no more than 0.05% of the panel dimensions in width and in length. All panel corners 40 shall be welded and ground smooth.

Figure 2:
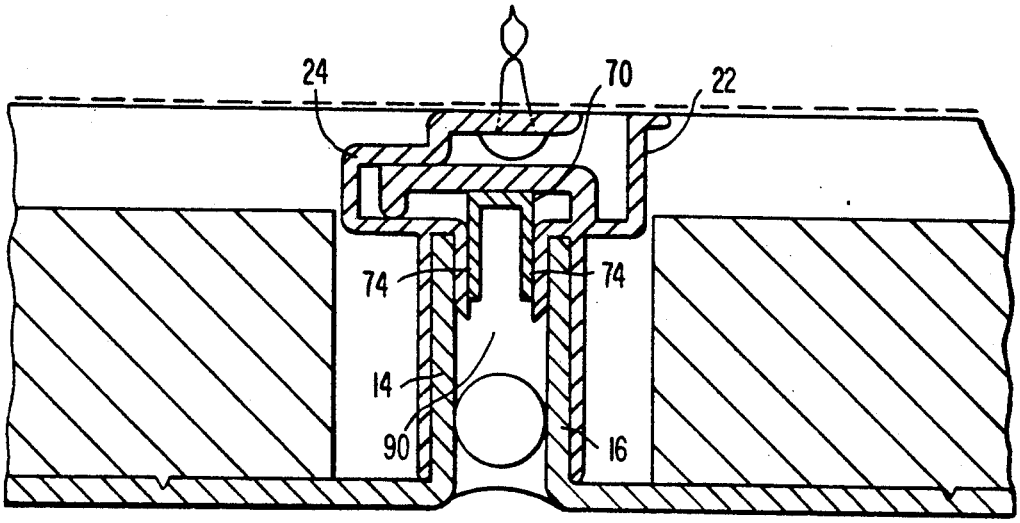
FIG. 2 is a cross-sectional view taken along lines 2'—2' of FIG. 1 and shows the joining of two adjacent panels to one another and to the exterior wall of the building.
Figure 3:
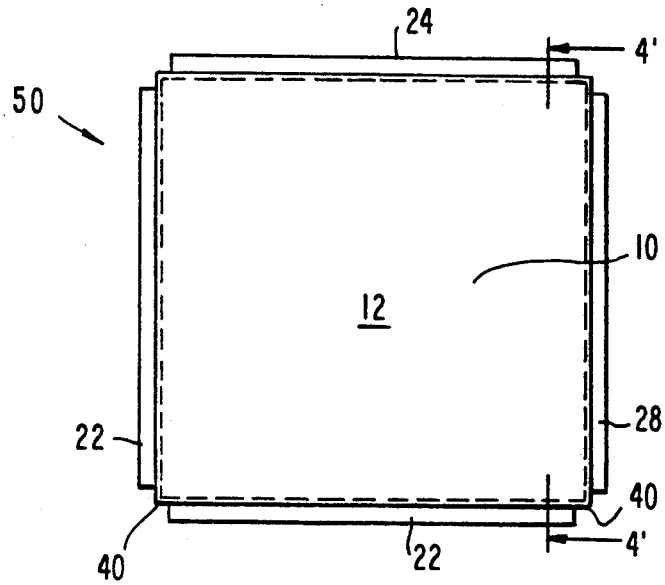
FIG. 3 is a front plan view showing an individual pan-like panel, prior to installation, with the panel being provided, at the factory, with two pairs of extruded channel members, male and female secured to the flanges of the panel.
Figure 4:
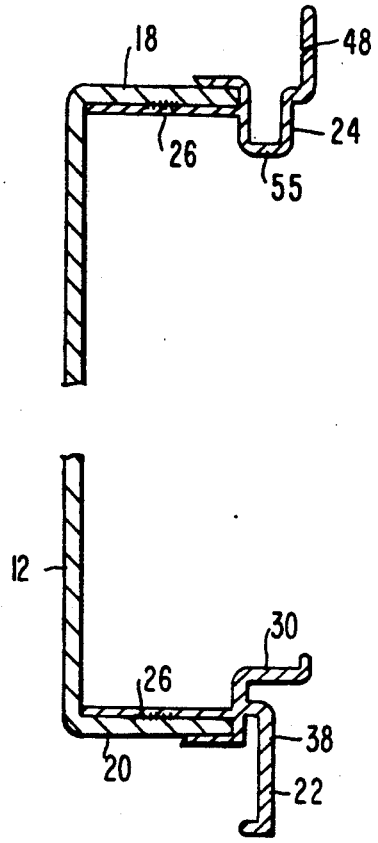
FIG. 4 is a cross-sectional view taken along lines 4'—4' of FIG. 3.

As can best be seen in FIGS. 2, 3 and 4, male and female channel members 22 and 24, respectively, are secured, by spot welding 26 to the flanges 14, 16, 18 and 20. According to the invention, male channel members 22 are secured to an adjacent pair of flanges as, for example, to side flange 16 and bottom flange 20 while female channel members 24 are secured to an adjacent pair of the other flanges of the pan-like panel 10 as, for example, to side flange 14 and top flange 18.

Thus, a panel assembly 50 is constructed at the factory which comprises the pan-like panel 10 and two pairs of male channel members 22 and female channel members 24 spot welded to the flanges of the principal wall 12 of the pan-like panel 10. The male and female channel members 22 and 24, respectively, are extruded parts also made from aluminum, which are shop cut in length and assembled to the pan-like panels.

Figure 5:
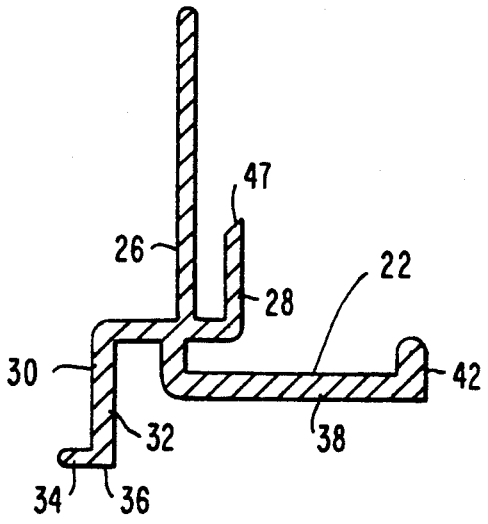
FIG. 5 is a cross-sectional view of the male channel member of the present invention.
Figure 6:
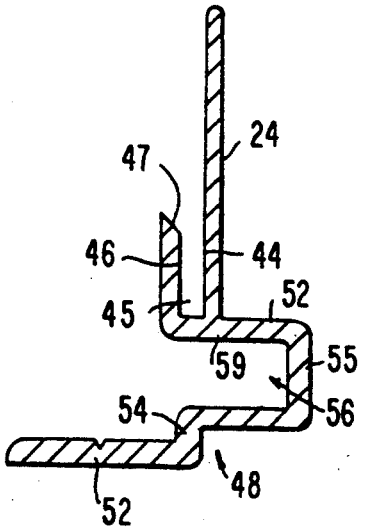
FIG. 6 is a cross-sectional view of the female channel member of the present invention.

As best seen in FIGS. 4, 5 and 6, the male channel member 22, in cross-section, has a plurality of legs, each of which provides a specific function. A flange, as, for example, bottom flange 20 of the pan-like panel 10 is secured between inside flange securing leg 26 and outside flange securing leg 28. Preferably, with the depth of the flanges being about 1⅜", the length of inside flange securing leg 26 is slightly less than 1⅜". The distance or space between inside flange securing leg 26 and outside flange securing leg 28 is substantially about the thickness of the flange to which the channel member is secured so that the flange is tightly secured therein. Male channel member 22, as mentioned, runs substantially along the entire length of the flange to which it is secured and, yet, it does not quite reach the corner 40 of the pan-like panel 10 as can be best seen and understood by reference to FIG. 3, which shows exposed corners 40. A spacer leg 30 comprises a first L-shaped portion 32 extending rearwardly from the inside flange securing leg 26 and terminates with a building contact foot 34, having a plane surface 36. Plane surface 36 is adapted to rest against the exterior wall to which the pan assemblies 50 (panels 10 with male and female channel members 22 and 24) are secured. The male channel member 22 has a male leg extension 38 and, extending at right angles thereto, a locking foot 42.

Figure 7:
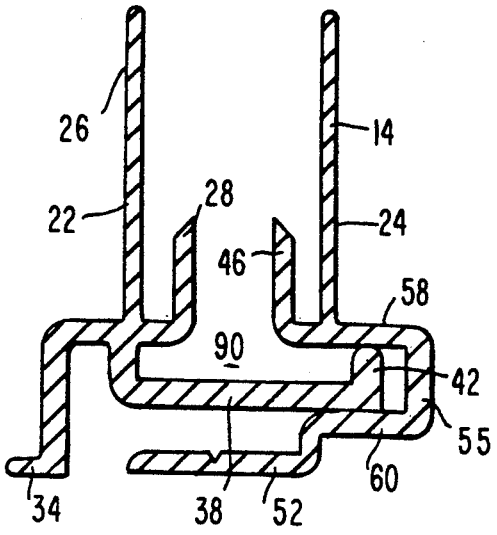
FIG. 7 is a cross-sectional view of the mechanical interlocking between the male and female channel members of the present invention, with the pan-like member and its flanges not being shown for clarity of illustration purposes.

As can be best seen by reference to FIGS. 4 6 and 7, the female channel member 24, in cross-section, similarly comprises a plurality of leg portions having specific functions which will now be described. An inside flange securing leg 44 is provided for contacting with the inside edge of the flanges of the pan-like panels 10. This leg extends for slightly less than about 1 3/8 of an inch in depth (which is substantially the depth of the flange from the inside surface of principal wall 12). Spaced from inside flange securing leg 44 is outside flange securing leg 46. The spacing or gap 45 is preferably the thickness of the flange to which the female channel member is secured. The female channel member 24 is, as with the male channel member 22, secured to the flanges by spot welding but it is within the contemplation of the present invention that the flanges can be secured by a friction fit, too. Both the outside flange securing leg 28 of the male channel member 22 and the outside flange securing leg 46 of the female channel member 24 are shorter, in depth, than the inside flange securing legs 26 and 44, respectively, for aesthetic purposes i.e., to show more of the panel, when assembled. In addition, both of the outside flange securing legs 28 and 46 are preferably provided with a bevel edge 47, 45° with respect to the planar surface of the leg.

To facilitate installation of the panels, the female channel member 24 is secured to the exterior wall of the building by a plurality of screws which pass through apertures (not shown) spaced in wall contacting leg 48. Wall contacting leg 48 has a planar wall contacting leg portion 52 which physically abuts against the wall or metal lattice structure to which the system is attached. A spacing leg portion 54 is perpendicular to planar wall contacting leg portion 52. A female, U-shaped receptacle 56, generally defined by extension leg portion 5, spacing leg portion 54 and leg 59 provides a lengthwise slot for selective mating receipt of male leg extension 38 and locking foot 42. This mating or interlocking can be best seen by reference to FIGS. 2 and 7. The distance between wall segments 58 and 60 (See FIG. 7) of the female U-shaped receptacle 56 is only slightly greater than the protrusion provided by locking foot 42 so that when male channel member 22 is inserted into female channel member 24, a slight frictional engagement occurs between the two members. The sidewise extension of male leg portion 38 from the inside flange securing leg 26 is such that, when the panels are secured, as will be explained, the screws which secure planar wall contacting leg portion 52 of the female channel members are covered and prevented from being manually loosened, as by vandals, or by natural forces. The affect provided by spacing leg 54 is sufficient to allow the screw heads to be located between male leg extension 38 and planar wall contacting leg portion 52.

Figure 8:
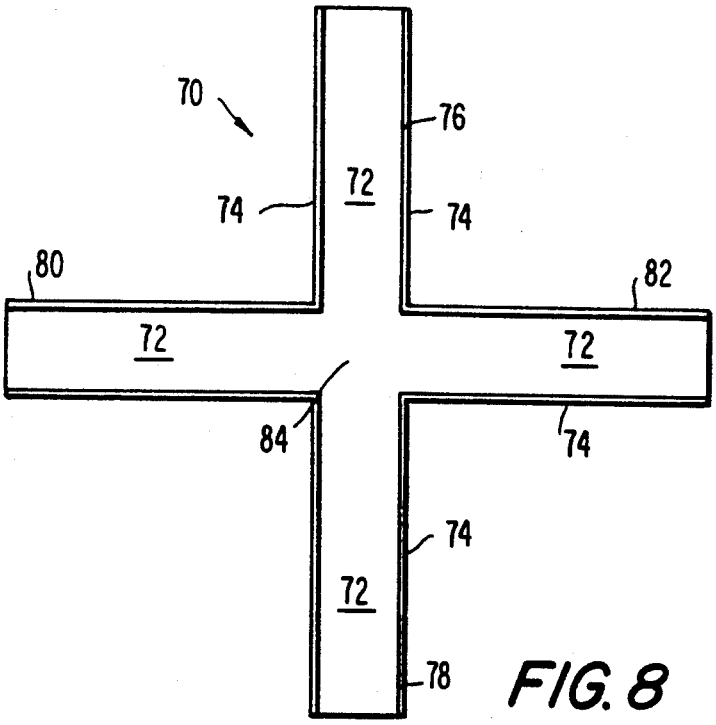
FIG. 8 is a front plan view of the gutter splice member of the present invention.

A gutter splice 70 is shown in FIG. 8. It is also shown in cross-section in FIG. 2. Preferably, this component of the present invention is fabricated from plastic. As can be seen in FIG. 2, the gutter splice is installed and frictionally secured between outside flange securing leg 28 of the male channel member 22 and outside flange securing leg 46 of the female channel member of an adjacent panel. The guttering splice 70 serves to provide continuity for removal of water from within the passageway defined between the outside flange securing legs of adjacent panels and, bounded on the rear by the male leg portion 38 of the male channel member. Use of the gutter splice 70, serves to ensure that water and moisture is not trapped within the structure. The gutter splice thus provides fluid continuity in both rows and columns and is an important part of the water removal system of the present invention. The gutter splice is basically an X-shaped plastic molded or extruded component having an X-shaped bottom wall 72. Extending forwardly from bottom wall 72 are a plurality of side walls 74. According to the preferred embodiment of the present invention, all thicknesses of the gutter splice 70 are about 0.03125". Each gutter splice has a top leg 76 and an aligned bottom leg 78. Similarly, each gutter splice 70 has a left side leg 80 and an aligned right side leg 82. Preferably, the gutter splice extends from top leg to bottom leg for about 3" and from left side leg to right side leg also for about 3". The X-shaped bottom wall 72 extends between the side walls 74 and is, preferably, about 5/16 of an inch wide. The top leg 76, bottom leg 78, left leg 80 and right leg 82 extends for about 1 11/32 of an inch from the central portion 84.

The panel assemblies 50 are, as mentioned, prefabricated at a factory. Basically, the pan-like panels 10 are first fabricated and then the male channel members 22 and female channel members 24 secured, as by spot welding, to the flanges of the principal wall 12. In an alternate embodiment of the present invention, the male and female channel members are riveted to the pan-like panels 10 or a plug weld is utilized for securing the extrusions to the panels. With the pan assemblies thus fabricated, installation can proceed at the building site as follows:

First, starting at a corner of the building, the female channel member and, specifically, the wall contacting leg 48 thereof is secured to the exterior wall surface or metal stud structure by a plurality of screws. Actually, the screws pass through apertures of wall contacting leg 52 (See FIG. 2). Alternatively, however, the female channel member can be physically secured to the metal stud framing which is itself secured to the exterior wall surface of the building sought to be provided with the panel system. In addition, the adjacent female channel member on the very same panel assembly 50 is also secured to the exterior wall or the metal stud framing, also with screws. Preferably, stainless steel screws are used for securing the female channel members to the wall or metal stud framing.

One leg, for example 80, of gutter splice 70 is held against outside flange securing leg 46 of the female channel member. With the first pan assembly 50 thus secured to the exterior wall or the metal stud framing, a second pan assembly 50 is brought adjacent to the first pan assembly such that the male leg extension of the male channel member of the second pan assembly slides into the female U-shaped receptacle portion 56 of the first pan assembly. The second pan assembly 50 is then pushed toward the first, already-secured pan assembly until the male leg portion 38 and, specifically, the locking foot 42 is fully received within the female U-shaped receptacle and until the locking foot 42 abuts wall 55 of the female U-shaped receptacle. With the pan assembly thus secured, the two female channel members 24 of the second pan assembly 50 are secured, again, utilizing stainless steel screws to the exterior wall surface or the metal stud framing. Alternatively, with the male channel member first received within the female U-shaped receptacle portion of the female channel member, the gutter splice 70 and, specifically, one of the legs of the gutter splice is inserted into the channel or passageways 90 (See FIGS. 2 and 7) so that the channel or passageways 90 in both the vertical and horizontal directions are placed in fluid continuity. Then, when additional panel assemblies 50 are secured to the pan assemblies (already-secured to the wall) proceeding in rows and columns, the other legs of the gutter splice are inserted or located between the channels or passageways 90 formed between the outside flange securing legs of the male and female channel members of adjacent panels and the male leg extension, with the bottom wall 72 of the gutter splice 70 held in contact against male leg portion 38. Then, a third panel assembly is secured to the wall of the building assembly again, with the male channel member being pushed into and receptively received within the female U-shaped receptacle of the adjacent panel. In this manner, rows and columns can be formed on the exterior wall surface, to provide an entire two-dimensional wall surface, as best shown in FIG. 1. At each corner 40 of four adjacent and opposed panels, a single gutter splice 70 is provided.

Preferably, the plastic gutter splice 70 is first provided with a bead of silicon sealant on its outside side walls to further insure that moisture does not become inadvertently trapped or able to seep behind the gutter splice.

Of course, assemblies 50 can be provided, on the inside of their pan-like panels 10, with suitable insulation. With the wall thus constructed, a butyl rod, backer or rubber material is provided close to the outside surface of the principal walls of the pan-like panels and, yet, between the side flanges 14 and 16 of adjacent panels. This butyl rod, backer or rubber material is then covered with a silicon sealant. In this manner, water and moisture is blocked from seeping back into the channel or passageway 90, defined between adjacent panels. However, to the extent water or moisture does become trapped between adjacent panels, the gutter splice 70 insures fluid continuity such that the water will weep down or be transmitted in both the vertical direction toward the ground and/or in the horizontal direction, toward an edge of the building and then down to the ground.

It should be appreciated, that to implement the present invention onto an existing wall structure it may be necessary to utilize a slightly different channel member as a starting member either at the bottom or at one edge of the building. This starting member provides a female receptacle for a male channel member of a first panel assembly. Similarly, special configurations may be required both at the roof line of the building and, in addition, at the ground level. These, however, do not form a part of the present invention and it is believed to be within the skill of one of ordinary skill in the art to construct and fabricate the same using the teachings of this disclosure.

The present invention has been described with respect to the drawings and a preferred embodiment of the invention but it will be appreciated that modifications of the invention may be made without departing from the spirit and scope of the invention as set forth in the attached claims.

We claim:

1. A paneling system for finishing a building's exterior facade comprising a plurality of pan assemblies arranged in aligned columns and rows, each of said pan assemblies comprising a pan-like panel having inturned flanges along each edge of its perimeter; a pair of male channel members and a pair of female channel members secured to adjacent of said flanges by flange securing means which secure to said flanges of said pan-like panel; said male channel members having a laterally extending leg extension; said female channel members having a wall securing means for facilitating mechanical attachment of said pan assembly to said exterior of said building, and a receptacle portion; said leg extension of a first of said male channel members of a first of said pan assemblies being matingly received in the receptacle portion of a female channel member of a second pan assembly, said male and female channel members providing a substantially continuous water guttering system such that moisture which may penetrate to said channel members is positively directed to flow in both the vertical and horizontal directions, along said channel members and between said aligned columns and rows of panels.

2. A paneling system as claimed in claim 1, wherein said male and female channel members are extruded aluminum.

3. A paneling system as claimed in claim 1, wherein said flange securing means comprises an inside flange securing leg of substantially the same depth as said flange of said pan-like panel, an outside flange securing leg of smaller dimension than said flange of said pan-like panel and a space between said inside and said outside flange securing legs, said space being substantially equal to the thickness of said flange of said pan-like member.

4. A paneling system as claimed in claim 1, wherein said male and female channel members are spot welded to said flange of said pan-like panel.

5. A paneling system as claimed in claim 1, wherein said receptacle portion of said female channel member is dimensioned so as to frictionally grip and engage the leg extension of said male channel member of an adjacent pan assembly.

6. A paneling system as claimed in claim 1, wherein said male channel member is further provided with a building contact leg which is coplanar with said wall securing means of said female channel member of an adjacent panel assembly.

7. A paneling system as claimed in claim 1, wherein said leg extension is provided with a locking foot which is frictionally and matingly received within the receptacle portion of said female channel member of an adjacent pan assembly.

8. A paneling system as claimed in claim 1, wherein said leg extension of said male channel member covers and overlaps said wall securing means of said female channel member of an adjacent panel assembly.

9. As paneling system as claimed in claim 1, wherein said flange securing means comprises outside flange securing legs which are beveled.

10. A paneling system as claimed in claim 1, wherein said pan-like panels are substantially rectangular.

11. A paneling system as claimed in claim 1, wherein said pan assemblies, including said male and female channel members are pre-assembled, off site to the building sought to be finished with said paneling system.

12. A paneling system as claimed in claim 1, wherein said male and female channel members provide structural rigidity to said pan assemblies.

13. A paneling system as claimed in claim 1, wherein said leg extension of said male channel member is of a sufficient lateral dimension so that a water guttering passageway is defined between adjacent pan assemblies.

14. A paneling system as claimed in claim 13, wherein said water guttering passageway is made substantially impervious to water and moisture by a butyl rod and sealant.

15. A paneling system as claimed in claim 1, wherein the space defined between said male channel members and said female channel members of adjacent pan assemblies are maintained in fluid continuity by a gutter splice means.

16. A paneling system as claimed in claim 15, wherein said gutter splice means is an X-shaped member having legs which extend into spaces defined between said male and female channel member of adjacent pan assemblies.

17. A paneling system as claimed in claim 15, wherein said gutter splice means is plastic.

18. A gutter splice device for use with a paneling system for finishing a building's exterior, said gutter splice device serving to provide fluid continuity for the water guttering spaces between adjacent panels secured to the exterior wall of a building provided with pan-like assemblies in aligned rows and columns, said gutter splice device being substantially X-shaped and having a plurality of legs, a leg being selectively inserted into said water guttering spaces between adjacent pan-like assemblies.

19. A gutter splice device for use between adjacent rows and columns of pan-like assemblies for finishing the exterior of a building, comprising a bottom wall capable of being placed in planar contact with a channel member secured to a pan-like assembly and also having side walls extending outwardly from said bottom wall, said side walls being in contact with said channel members of a pair of adjacent pan assemblies.

20. A gutter splice device as claimed in claim 19, made from plastic.

21. A gutter splice device as claimed in claim 19 which is substantially X-shaped.

22. A gutter splice device as claimed in claim 19, which is secured between water guttering spaces of adjacent pan assemblies by use of a suitable sealant.

* * * * *